US006161652A

United States Patent [19]

Kostka et al.

[11] Patent Number: 6,161,652

[45] Date of Patent: Dec. 19, 2000

[54] METHOD AND APPARATUS FOR CONTROLLING ELEVATOR CARS IN A COMMON SLING

[75] Inventors: Miroslav Kostka, Ballwil; Raffaele Starace, Buchrain; Walter Koch, Root, all of Switzerland

[73] Assignee: Inventio AG, Hergiswil NW, Switzerland

[21] Appl. No.: 09/241,231

[22] Filed: Feb. 1, 1999

[30] Foreign Application Priority Data

Feb. 2, 1998 [EP] European Pat. Off. ..... 98810078

[51] Int. Cl.[7] ..... B66B 1/40

[52] U.S. Cl. ..... 187/291; 187/902

[58] Field of Search ..... 187/249, 291, 187/264, 277, 285, 414, 902

[56] References Cited

U.S. PATENT DOCUMENTS

| | | | |
|---|---|---|---|
| 1,914,128 | 6/1933 | James et al. | 187/249 |
| 1,946,982 | 2/1934 | McPeak | 187/264 |
| 4,434,466 | 2/1984 | Friedli et al. . | |
| 4,484,264 | 11/1984 | Friedli et al. . | |
| 5,220,981 | 6/1993 | Kahkipuro et al. | 187/277 |
| 5,907,136 | 5/1999 | Hongo et al. | 187/277 |

FOREIGN PATENT DOCUMENTS

| | | |
|---|---|---|
| 0 026 406 | 4/1981 | European Pat. Off. . |
| 0 050 304 | 4/1982 | European Pat. Off. . |
| 0 050 305 | 4/1982 | European Pat. Off. . |
| 0 365 782 | 5/1993 | European Pat. Off. . |
| 1 113 293 | 8/1961 | Germany . |
| 09124240 | 5/1997 | Japan . |

*Primary Examiner*—Jonathan Salata
*Attorney, Agent, or Firm*—MacMillan, Sobanski & Todd, LLC

[57] ABSTRACT

A method and an apparatus for controlling an elevator is equipped with a deck-distance drive machine which by reference to positional information adjusts the distances between the individual cars in a common car sling in such a way that each car can stop at the corresponding floor accurately, i.e. without forming a step. Measured values of floor position are stored in memories and periodically updated so as to detect any changes such as, for example, building settlement. Based on this data the necessary deck-distances are calculated which are necessary for all the cars to stop without any of them forming a step. Furthermore, the method and the device can be correspondingly extended for a multi-decker elevator and for any type of control (conventional control, destination call control, etc.).

14 Claims, 3 Drawing Sheets

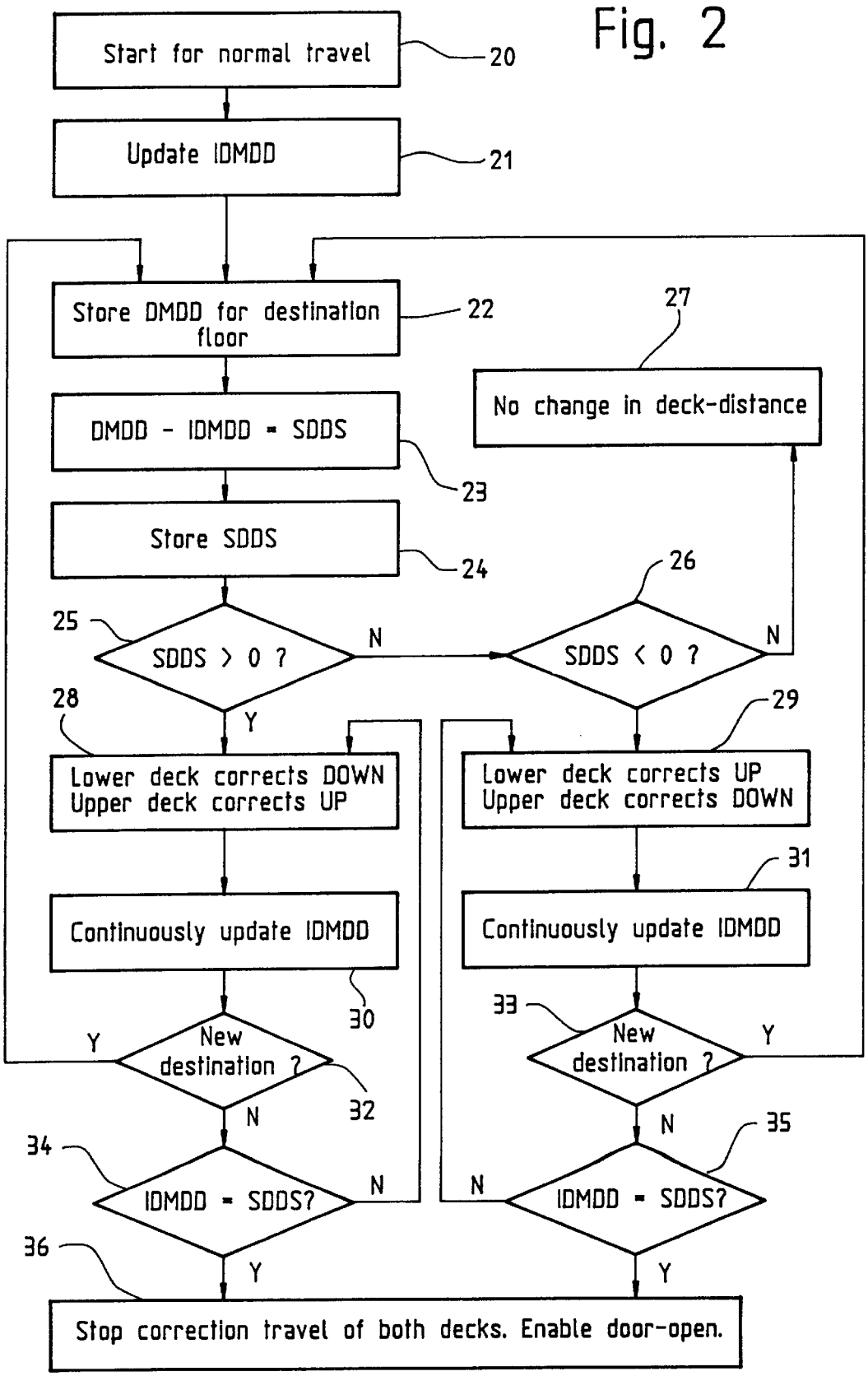
Fig. 2
Start for normal travel
20
Update IDMDD
21
Store DMDD for destination floor
22
DMDD - IDMDD = SDDS
23
Store SDDS
24
25
SDDS > 0 ?
N
Y
26
SDDS < 0 ?
N
27
No change in deck-distance
28
Lower deck corrects DOWN
Upper deck corrects UP
29
Lower deck corrects UP
Upper deck corrects DOWN
31
Continuously update IDMDD
Continuously update IDMDD
30
33
New destination ?
Y
New destination ?
Y
32
N
N
34
IDMDD = SDDS?
N
N
IDMDD = SDDS?
35
36
Y
Y
Stop correction travel of both decks. Enable door-open.

METHOD AND APPARATUS FOR CONTROLLING ELEVATOR CARS IN A COMMON SLING

BACKGROUND OF THE INVENTION

The present invention relates generally to elevators and, in particular, to a method and a device for adjusting the distance between the decks of double-decker and multi-decker elevators.

The German patent DE 1 113 293 shows an elevator installation that consists of an elevator with two cars, one beneath the other, which together have the height of two stories. The two cars, which are caused to move by a common motor, are fastened immovably together and form a so-called double-decker elevator.

In the double-decker elevator installation described above, the two cars are joined immovably together and do not permit any change in their positions relative to each other. In this case, the distance between floors must be kept exactly the same over the entire height of the building; otherwise steps occur with one or even both of the decks when the elevator stops at a landing. The same problem arises if settlement occurs in the walls of a building months or years after it has been constructed, or if the tolerances are not adhered to, which has a particularly pronounced effect in tall buildings. A control system on a double-decker elevator of the type mentioned above is not able to cause both cars to halt in exactly the right position at the respective landings. Stopping inaccuracies, or so-called steps, occur on at least one and possibly both of the cars.

SUMMARY OF THE INVENTION

The objective of the invention is a double-decker or multi-decker elevator which does not have the disadvantages mentioned above.

The present invention concerns a method and an apparatus for controlling an elevator, the elevator having at least two cars arranged in a common car sling which travels in an elevator hoistway in a building having a plurality of floors and is driven by a hoisting machine via a suspension rope. The elevator control is initialized by: determining a distance (SD) value for a distance between each pair of adjacent floors served by two cars arranged in a common car sling travelling in an elevator hoistway in a multi-floor building; determining a mean deck-distance (MDD) value representing a mean of the largest and smallest distance (SD) values; and determining a floor difference (DMDD) value representing a difference between the mean deck-distance (MDD) value and the distance (SD) value corresponding to each pair of the adjacent floors. During operation of the elevator, one of the pairs of adjacent floors at which to stop the cars is selected, a car difference (IDMDD) value representing a difference between the value of the actual deck-distance between the cars and the mean deck-distance (MDD) value is determined, a movement distance (SDDS) value representing the difference between the floor difference (DMDD) value corresponding to the selected adjacent floors and the car difference (IDMDD) value is determined, the cars are moved the movement distance (SDDS) value relative to one another, and the cars are stopped at a predetermined position relative to the selected adjacent floors.

The advantages resulting from the invention are mainly derived from the fact that the cars can stop accurately in position at the respective floors, in other words without forming a step, even in buildings where the distance between floors varies. By means of the measures described in the below, advantageous further developments and improvements can be achieved in the method and device for adjusting the distance between the decks of double-decker or multi-decker elevators. The control unit stores and periodically updates measured values of position to identify possible changes such as building settlement. This data is used to calculate the distances between decks which are necessary to ensure that when the cars stop, all of them do so without forming a step. Furthermore, in any type of control system (conventional control, destination call control, etc.) the necessary distance between decks required for the next stop in sequence can be adjusted during travel and before stopping.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 2 is a flowchart showing the control process of the deck-distance control shown in the FIG. 1 for adjusting the deck-distance during travel.

DESCRIPTION OF THE PREFERRED EMBODIMENT

Figure 1:
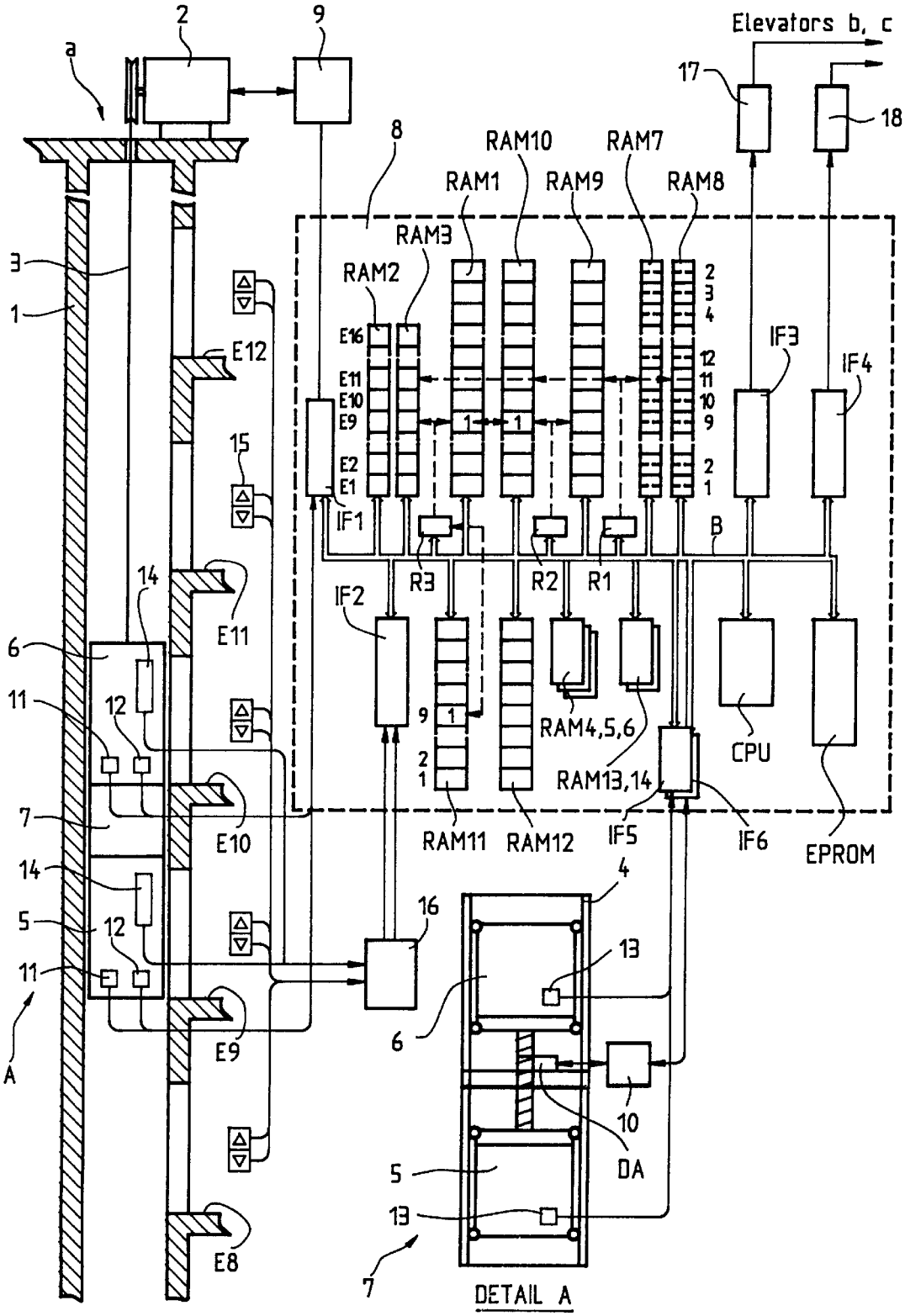
FIG. 1 is a schematic block diagram of a deck-distance control according to the present invention for one elevator of a group of three elevators.

FIG. 1 illustrates a deck-distance control according to the present invention for one elevator of a group of three elevators which makes use of a group control, for example of the type shown in the European patent EP 0 365 782. An elevator "a" travels in one of the hoistways 1 of a group of elevators consisting of, for example, three elevators "a", "b" and "c". Via a suspension rope or cable 3, a hoisting machine 2 causes a double-decker elevator 7, consisting of two cars 5 and 6 in a common car sling 4, to travel in the elevator hoistway 1, the elevator installation chosen for the example serving sixteen floors E1 to E16 (only floors E8 through E12 being shown). By means of a spindle gearbox, for example, a driving mechanism shown in "Detail A" of FIG. 1, a so-called deck-distance drive machine DA, can change the relative deck-distance between the cars 5 and 6 in such a way that this always matches the distance between two adjacent floors at which the cars are directed to stop.

The hoisting machine 2 is controlled by a drive control, for example of the type shown in the European patent EP 0 026 406, in which generation of the reference values, the control functions, and initiation of stopping are effected by means of a microcomputer system 8, and in which a sensor and actuator 9 of the drive control, which are connected to the microcomputer system via a first interface IF1. A sensor and actuator 10 of the deck-distance drive machine DA are connected to the microcomputer system 8 via an interface IF5. The microcomputer system 8 processes the necessary information, which is represented in the flowchart shown in the FIG. 2.

Each of the cars 5 and 6 of the double-decker elevator 7 is equipped with a load-measuring device 11, a device 12 to indicate the momentary operational state "Z" of the cars, a device 13 to register the positions of the cars in relation to the complete elevator, and car-call emitters 14. The devices 11 and 12 are connected to the microcomputer system 8 via the interface IF1, and the sensor and actuator 10 are connected to the microcomputer system via an interface IF6. The car-call emitters 14, and hall-call emitters 15 provided on the landings, are connected to the microcomputer system 8 via an input device 16 of a type known, for example, from the European patent EP 0 062 141 and a second interface IF2. The microcomputer system 8 consists of a hall-call memory RAM1; two car-call memories RAM2 and RAM3 corresponding to the cars 5 and 6 respectively of the double-decker elevator 7; a load memory RAM4 that stores the momentary load "$P_M$" of each car; two memories RAM5 and RAM6 that store the operating state "Z" of the cars; two partial-cost memories RAM7 and RAM8 in the form of tables corresponding to the cars of the double-decker elevator; a first total-cost memory RAM9; a second total-cost memory RAM10; a deck-to-call allocation memory RAM11; a memory RAM12 which provides the elevator with the lowest serving costs for each sampling and direction of service; a memory RAM13 containing for all 10 adjacent-floor distances the calculated differences relative to a mean deck-distance "DMDD"; a memory RAM14 for the values of mean deck-distance "MDD", actual deck-distance difference "IDMDD", reference deck-distance correction "SDDS", etc.; a program memory EPROM; a data memory "DBRAM" (not shown) secured against power-supply failure; and a microprocessor CPU which is connected via a bus B to the memories RAM1 through RAM14, EPROM and DBRAM. R1 and R2 designate a first and a second sampler of a sampling device in which the samplers are registers by means of which addresses corresponding to the floor numbers and the direction of travel are calculated. The cost memories RAM7 through RAM10 each have one or more storage locations to which the individual possible car positions can be assigned. R3 and R4 (not shown) designate the selectors corresponding to the individual cars in the form of a register, which indicates for a traveling car the addresses of those floors at which the car can still stop. When the car is stationary, selectors R3 and R4 indicate the floor on which a call can be served, or a possible car position (for "blind" floors). As already known from the drive control mentioned above, destination routes are assigned to the selector addresses and these destination routes can be compared with a destination value generated by a reference value generator. If the two routes are identical and a stop command is present, the deceleration phase is initiated. If no stop command is present, the selectors R3 and R4 are set to the next floor.

The microcomputer systems of the individual elevators a, b and c are connected together via a comparator 17 of a type known, for example, from the European patent EP 0 050 304, a third interface IF3, a partyline transmission system 18 of a type known, for example, from European patent EP 0 050 305, and a fourth interface IF4, and thereby form a group control with adjustment of the deck-distance for double-decker or multi-decker elevators.

The following functional description relates to a double-decker elevator whose decks (cars) 5 and 6 are both moveable relative to the elevator sling. If one of the decks (cars) is immovably fastened to the car sling 4, and only the second car is constructed to be movable, the flowcharts for control of the deck-distance can be derived from the flowcharts illustrated and described in the FIG. 2.

Similarly, in the case of a multi-decker elevator, all of the cars can be constructed to be movable relative to the car sling, or one of the cars can be immovably fastened to the sling and the remaining cars can be constructed to be movable relative to the car sling.

The value for the mean deck-distance "MDD" is defined from the layout of the building floors and hoistways as the mean of the largest and smallest floor-to-floor distances of two adjacent floors, where adjacent floors are understood to include only those floors which can be served by the elevator when it stops. For those floors which can be served by the double-decker elevator 7 in such a way that one of the decks comes to rest in an area of the hoistway where there is no hoistway door (e.g. in an express zone), the mean deck-distance "MDD" can be used as the control value.

For each double stop, i.e. for each stop at which both of the cars 5 and 6 serve a floor, the difference between the mean deck-distance "DMDD" and the deck-distance for the corresponding stop is calculated:

A positive value of "DMDD" indicates that the cars must be further apart than "MDD" by this distance in order for the two cars to be exactly level with the two floors simultaneously.

A negative value of "DMDD" indicates that the cars must be closer together than "MDD" by this distance for the two cars to be exactly level with the two floors simultaneously.

These "DMDD" values for all double stops are stored in a table in the memory RAM13.

The relative car position is determined by a suitable device, for example an impulse tachodynamo and a corresponding transducer for measuring the distance.

The difference between the distance between the two cars 5 and 6 and "MDD" is continuously updated as the difference between the actual deck-distance and the mean deck-distance "IDMDD". "IDMDD" can be a positive or a negative value. For example, "IDMDD=−10" indicates that the two cars 5 and 6 are ten cm closer together than specified by "MDD".

As soon as the next stop is known, how far apart the two cars should be can be read from the table containing the stored "DMDD" values. The difference between "DMDD" and "IDMDD" gives the distance "SDDS" for the movement of the two cars 5 and 6 relative to each other.

"SDDS" represents the distance by which the cars 5 and 6 must move away from or towards each other so that the two cars stop exactly level with the landings at the destination stop. A positive value of "SDDS" indicates that the cars must move away from each other. A negative "SDDS" value indicates that the cars must move towards each other.

The deck-distance control selects the direction of the distance-adjusting movement of one or both of the cars 5 and 6, and checks whether the cars have reached the desired distance, and that the cars have not reached an extreme position, i.e. a possible maximum upper or lower deck position relative to the elevator.

The control of the relative positioning of the two cars 5 and 6 is activated by the following events, for example:

The car is in the acceleration phase and the destination is known.

A new destination calculated during travel is known.

The drive part of the elevator control (not the deck-distance control) ensures that the elevator stops accurately. It always directs the double-decker elevator 7 with the two movable cars 5 and 6 to the mid-point between two adjacent floors. The two cars 5 and 6 always increase or reduce symmetrically their relative distance from the mid-point of the double-decker elevator 7. If one of the cars 5 and 6 is immovably fastened to the elevator sling, the elevator control guides the elevator 7 in such a way that the immovable car represents the reference position for the destination floor.

The drive part of the elevator control also carries out releveling of the double-decker elevator 7, in accordance with the load in the two cars 5 and 6. At the time when releveling is carried out, the positions of the two cars relative to the elevator frame are already fixed. For this reason releveling is carried out to both landing levels at the same time and in the same direction.

The tables containing the values for controlling the deck-distance on a double-decker elevator 7 are initialized during a measuring travel in the manner described below. (In the case of a multi-decker elevator, the value tables would be created, initialized and used analogously):

All distances between adjacent floors "SD" are measured.

The largest, smallest, and mean floor-to-floor distances are calculated. The mean floor-to-floor distance corresponds to the mean deck-distance "MDD".

For each pair of floors representing a stop, the difference relative to the mean floor-to-floor distance DMDD is calculated.

The measured position values are stored and updated during each travel, or periodically, to detect any changes which may have taken place, such as building settlement, for example. These values are used to calculate the deck-distances necessary for both cars 5 and 6 to stop without either of them forming a step. Furthermore, the procedure can be carried out not only with a conventional group control, but with any desired type of control (destination floor control, etc.).

FIG. 2 contains a flowchart for the procedure to control the adjustment of the deck-distance during travel. When the elevator starts to move 20, "IDMDD" is updated 21, "DMDD" for the destination floor pair is stored 22, the reference value of the deck-distance correction "SDDS" is calculated as the difference between "DMDD" (the difference relative to the mean deck-distance) and "IDMDD" (the actual difference relative to the mean deck-distance) 23 and "SDDS" is stored 24. If the deck-distance is already at the necessary value, which means that the reference value of the deck-distance correction is zero in accordance with the decision points 25 and 26, no action is taken 27, as both cars 5 and 6 will stop level with the respective landings at the destination stop.

Figure 3A:
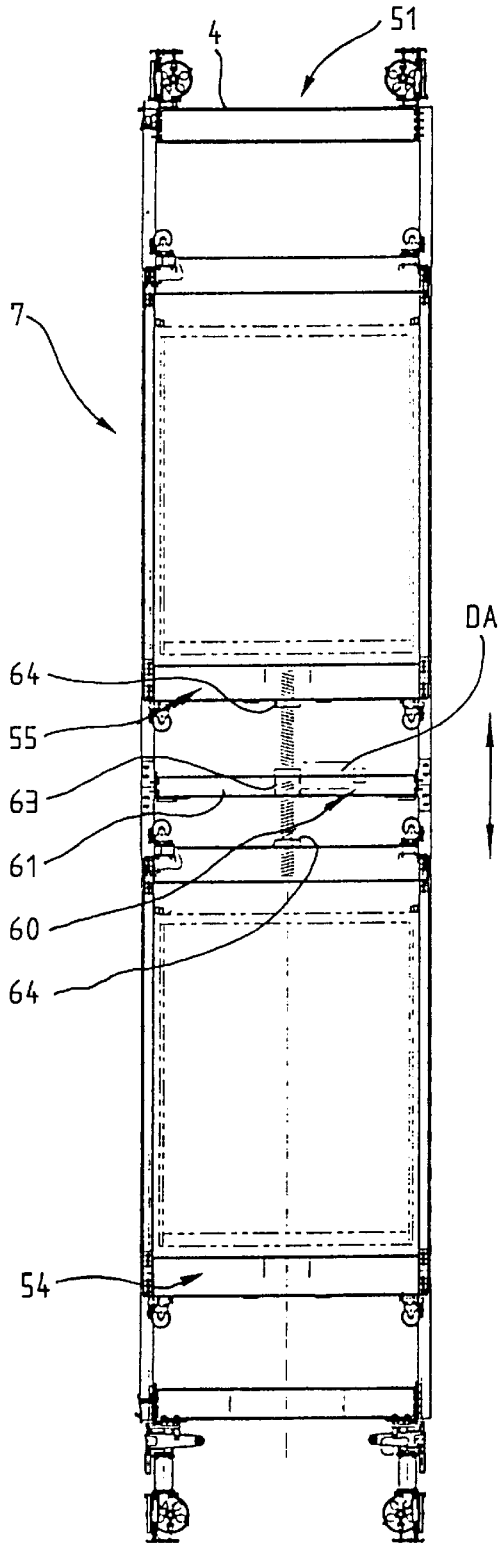
FIGS. 3*a* and 3*b* are schematic view front and side elevation views respectively of a device according to the present invention for adjusting the distance between decks on a double-decker elevator.
Figure 3B:
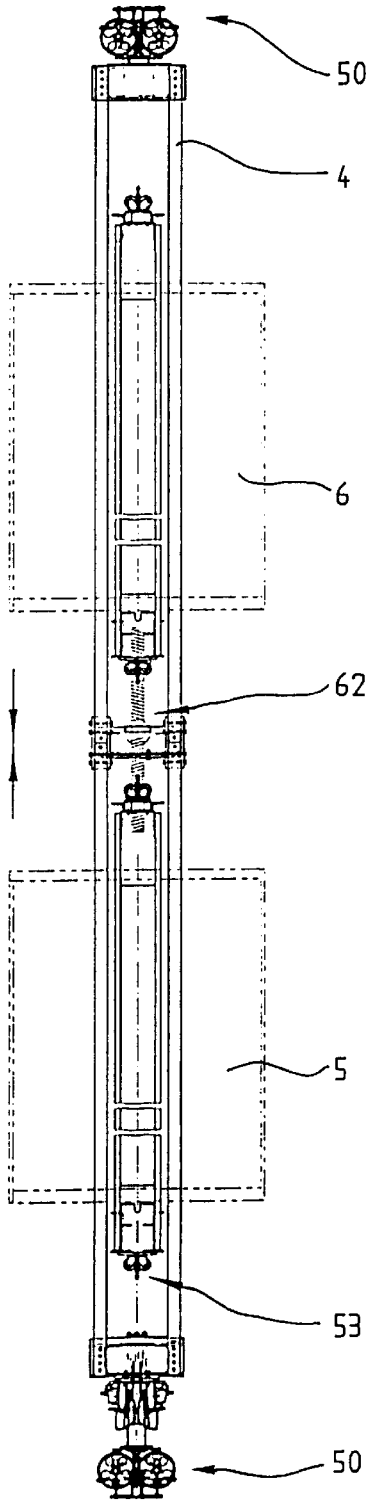

While the elevator is traveling, and the two decks are moving relative to each other 28 and 29, the actual difference relative to the mean deck-distance "IDMDD" is continuously updated 30 and 31, because if there is a change in the destination floor 32 and 33 the new reference value "SDDS" for the deck-distance correction must be calculated and the process for adjusting the distance between the decks has to be repeated. When adjustment of the distance between the decks is complete 34 and 35, an open-enable signal is transmitted to the doors 36. While the doors are being opened, all other measures specified by regulations or necessary for control purposes are applied. Both decks stop exactly level with the respective landings. FIG. 3 contains a diagrammatic representation of a device for adjusting the distance between the decks on a double-decker elevator 7 with two cars 5 and 6 which are movable relative to the car sling 4. The two cars 5 and 6 are arranged in the common car sling 4 which is fitted with guides 50 and a means of suspension 51. The two cars 5 and 6 each have a separate car sling 54 and 55 respectively, with guides 53 which run on guide rails. The position of the two cars 5 and 6 relative to each other is calculated by means of, for example, an impulse tachodynamo 60. Between the cars 5 and 6 the deck-distance drive machine (DA), which has an electric motor, is fastened to a plate 61 on the car sling 4. The control of this drive is located, for example, in the machine room of the elevator installation. Displacement of the cars 5 and 6 relative to each other is effected, for example, by a spindle 62, having opposite-handed threads for the two cars respectively, which passes through an opening 63 in the plate 61. The car slings 54 and 55 have threaded plates 64 which accommodate the spindle 62. When the distance between the decks is adjusted, i.e. when the spindle 62 is driven by the deck-distance drive machine DA, the distance between the cars 5 and 6 increases or decreases symmetrically about the mid-point of the double-decker elevator 7. As an alternative to the spindle 62 it is possible to use, for example, a scissor jack, a hydraulic jack, or some other sort of drive.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for controlling an elevator, the elevator having at least two cars arranged in a common car sling which travels in an elevator hoistway in a building having a plurality of floors and is driven by a hoisting machine via a suspension rope, comprising the steps of:

a. determining a distance (SD) value for a distance between each pair of adjacent floors served by two elevator cars arranged in a common car sling travelling in an elevator hoistway in a multi-floor building;

b. determining a mean deck-distance (MDD) value representing a of the largest and smallest ones of the distance (SD) values determined in said step a.;

c. determining a floor difference (DMDD) value representing a difference between the mean deck-distance (MDD) value and the distance (SD) value corresponding to each pair of the adjacent floors;

d. selecting one of the pairs of adjacent floors at which to stop the cars;

e. determining a car difference (IDMDD) value representing a difference between the value of the actual deck-distance between the cars and the mean deck-distance (MDD) value;

f. determining a movement distance (SDSS) value representing the difference between the floor difference (DMDD) value corresponding to the selected adjacent floors and the car difference (IDMDD) value;

g. moving the cars the movement distance (SDSS) value relative to one another; and h. stopping the cars at a predetermined position relative to the selected adjacent floors.

2. The method according to claim 1 wherein said steps a., b. and c. include storing the distance (SD) values, the mean deck-distance (MDD) value and the floor difference (DMDD) values respectively and performing said steps d. through h. for subsequently selected pairs of the adjacent floors utilizing the stored floor difference (DMDD) value.

3. The method according to claim 1 wherein said steps a. through c. are performed during a measuring travel of the cars.

4. The method according to claim 1 wherein said steps a. through c. are performed during each travel of the cars.

5. The method according to claim 1 wherein said steps a. through c. are performed during subsequent selected travels of the cars to detect any changes in the distance (SD) values and include storing the distance (SD) values, the mean deck-distance (MDD) value and the floor difference (DMDD) values respectively.

6. The method according to claim 1 wherein said steps e. through g. are performed when the cars are in an acceleration phase of travel.

7. The method according to claim 1 wherein said steps e. through g. are performed when the selected pair of adjacent floors is changed during travel of the cars.

8. A method for controlling an elevator, the elevator having at least two cars arranged in a common car sling which travels in an elevator hoistway in a building having a plurality of floors and is driven by a hoisting machine via a suspension rope, comprising the steps of:

a. determining and storing in memory a distance (SD) value for a distance between each pair of adjacent floors served by two cars arranged in a common car sling travelling in an elevator hoistway in a multi-floor building;

b. determining and storing in memory a mean deck-distance (MDD) value representing a mean of the largest and smallest distance (SD) values determined in said step a.;

c. determining and storing in memory a floor difference (DMDD) value representing a difference between the mean deck-distance (MDD) value and the distance (SD) value corresponding to each pair of the adjacent floors;

d. selecting one of the pairs of adjacent floors at which to stop the cars;

e. determining a car difference (IDMDD) value representing a difference between the value of the actual deck-distance between the cars and the mean deck-distance (MDD) value;

f. determining a movement distance (SDSS) value representing the difference between the floor difference (DMDD) value corresponding to the selected adjacent floors and the car difference (IDMDD) value;

g. moving the cars the movement distance (SDSS) value relative to one another; and h. stopping the cars at a predetermined position relative to the selected adjacent floors.

9. An apparatus for controlling an elevator having at least two cars in a common car sling which travels in an elevator hoistway in a multi-floor building comprising: a deck-distance drive machine attached to a common car sling supporting at least two elevator cars for travel in a hoistway, at least one of the cars being movable relative to the car sling, said deck-distance machine being coupled to the at least one car; and a control connected to said deck-distance drive machine for receiving a signal representing a selected pair of adjacent floors at which the cars are to be stopped whereby when said deck-distance drive machine is attached to the car sling and coupled to the at least one car, said deck-distance drive machine responds to said control to selectively adjust the distance between the cars to correspond to a distance between the selected pair of adjacent floors to be served by the cars; said control including a memory containing calculated floor difference (DMDD) values relative to a mean deck-distance (MDD) value of floor-to-floor distance (SD) values of all pairs of adjacent floors and said control comparing the one of said calculated floor difference (DMDD) values corresponding to the selected pair of adjacent floors with an actual car distance (IDMDD) value representing a difference between a value of the actual distance between the cars and said mean deck-difference (MDD value to control said deck-distance drive machine.

10. The apparatus according to claim 9 wherein no more than one of the cars is immovably fastened to the car sling.

11. The apparatus according to claim 9 wherein the elevator has a pair of cars movable relative to the car sling and including a spindle connected between the car sling and the two cars and coupled to said deck-distance drive machine for changing a distance between the two cars symmetrically about a mid-point between the two cars.

12. The apparatus according to claim 9 including a sensor connected to said control for generating a signal representing an actual distance between the cars, said control responding to said actual distance signal and the distance between the selected pair of adjacent floors to adjust the distance between the cars.

13. The apparatus according to claim 1 wherein said control selectively updates said calculated difference (DMDD) values to detect any changes in the floor-to-floor distances.

14. The apparatus according to claim 9 wherein said control calculates a movement distance (SDDS) value as a difference between said one floor distance (DMDD) value and said actual deck-distance (IDMDD) value representing the distance the cars must be moved and adjusts the distance between the cars in accordance with said movement distance (SDDS) value.

* * * * *